United States Patent [19]

Laudenschlarger et al.

[11] 4,153,929

[45] May 8, 1979

[54] LIGHT ASSEMBLY

[75] Inventors: W. Philip Laudenschlarger, Los Altos; Richard K. Jobe; Richard P. Jobe, both of Los Altos Hills, all of Calif.

[73] Assignee: Meddev Corporation, Los Altos, Calif.

[21] Appl. No.: 734,001

[22] Filed: Oct. 20, 1976

[51] Int. Cl.[2] ..... F21V 7/09

[52] U.S. Cl. ..... 362/348; 362/350; 350/292

[58] Field of Search ..... 240/41.36, 41.35 R, 240/41.37; 362/215, 343, 346, 347, 348, 349, 350, 297; 350/292, 293, 294, 295, 109

[56] References Cited

U.S. PATENT DOCUMENTS

| | | | |
|---|---|---|---|
| 1,133,955 | 3/1915 | Gray | 362/349 |
| 1,726,379 | 8/1929 | Benford | 240/41.36 |
| 1,819,725 | 8/1931 | Wood | 240/41.37 |
| 2,771,001 | 11/1956 | Gretener | 240/41.35 R |
| 3,666,939 | 5/1972 | Ota | 362/348 X |

*Primary Examiner*—William M. Shoop
*Assistant Examiner*—Peter S. Wong
*Attorney, Agent, or Firm*—David E. Lovejoy

[57] ABSTRACT

Disclosed is a multi-faceted light reflector and a method of manufacturing the reflector. Planar facets are arranged in tiers, or in some other order, tangent to the surface of a spheroid to form the reflector. The size and location of the facets are correlated to the size and location of the illuminated plane. A light source is located at one focus and the illuminated plane is located at the other focus where the illuminated plane is perpendicular to the major axis of the spheroid. The facets are dimensioned and positioned so that substantially all of the reflected light from the light source is reflected to a preselected area on the illuminated plane. The method of manufacture includes calculating the coordinates for each facet, forming a convex die from the calculated coordinates, and molding the concave reflector from the convex die thus formed.

12 Claims, 10 Drawing Figures

LIGHT ASSEMBLY

BACKGROUND OF THE INVENTION

The present invention relates to the field of optical reflectors and particularly to light assemblies which produce efficient and uniform illumination.

Light sources and reflectors have been the subject of design for many years. Many attempts have been made to design reflectors and light assemblies which provide efficient illumination. The need for improved light assemblies is particularly keen in the surgical and dental fields where high quality illumination is essential.

In the surgical and dental fields, illumination from the light assembly is frequently into a cavity. When illuminating a cavity, it is desirable that the cavity walls parallel to the optical axis of the light assembly receive adequate illumination. Also, it is desirable that a uniform flux distribution be available over the illuminated area so that variations in illumination do not interfere with observations. Also, shadowless illumination is desired. When a light path is interrupted, for example, by a medical instrument, the shadow effect should be minimized.

While the needs in the medical fields are important, light assemblies having specialized qualities of illumination are also important in other fields. For example displays of all types require specialized lighting. Art gallery displays frequently require uniform illumination and require illuminated areas of selected sizes.

Specialized light assemblies and reflectors are also required in projection systems which require a light source of uniform flux distribution in order to uniformly illuminate film or other objects.

Light assemblies and reflectors of many designs have long been known in which a light source is utilized with an elliptical or parabolic reflector. In U.S. Pat. No. 1,133,955, a light source placed at the focus of a parabolic reflector is described for reflecting light in lines parallel to the axis of the reflector. Light assemblies employing parabolic reflectors present a problem when they are illuminating a cavity. The portions of the cavity wall parallel to the optical axis of the parabolic reflector do not receive adequate illumination since the light rays are parallel to the wall. Also, parabolic reflectors do not minimize shadows. U.S. Pat. No. 1,133,955 also describes light originating from the first focus of an elliptical reflector being reflected to a point at the second focus of the reflector.

In order to illuminate any substantial area using an elliptical reflector, the illuminated plane conventionally has been moved away from the second focus of the ellipse, that is, to an out of focus location. For an out of focus illuminated plane the intensity of the incident light varies over the illuminated surface, that is, has a non-constant flux gradient. This condition results because the elliptical reflector projects a three-dimensional image of the light source at the second focus.

One solution to the problem of flux gradient was described in U.S. Pat. No. 1,253,813 where multi-faceted reflectors were described. The reflecting power of facets was reduced for the facets located in the tier located closer to the central axis of the reflector. While such reduction in reflective power makes the incident flux more uniform, the reduction in the reflectivity of the facets reduces the efficiency of the reflector. A reduction in the efficiency of the reflector, however, is exactly the antithesis of what is desired. Also, that patent had no correlation between the facet size and the illumated area.

In view of the above background, it is an objective of the present invention to provide an improved reflector which has greater efficiency because of a substantially uniform flux distribution over the illuminated area, and which reflects essentially all the incident flux emitted by the source into the illuminated area.

BRIEF SUMMARY OF THE INVENTION

The present invention is an improved reflector and light assembly and a method of manufacture thereof. The reflector includes a plurality of facets arrayed such that a central point of each facet is a tangent point on a spheroid surface defined by an ellipse of revolution. The spheroid for a particular reflector design in defined by the distance between first and second foci, the size of the illuminated area, the maximum diameter of the reflector and the angle of the facets in the reflector. A light source is located at the first focus, and a coalescently illuminated area exists at the second focus. The reflector is designed and each of the facets is constructed with outer bounds which define the outer bounds of the illuminated area. In this way, the size and shape is determined by the size and shape of the facets.

In accordance with one embodiment, the facets are arrayed in tiers concentrically located around the major axis of the spheroid.

In another embodiment, substantially all facets in a tier are substantially the same size.

In still another embodiment, substantially all facets have surfaces with substantially the same reflective power.

In an additional embodiment, substantially all of the facets are planar.

One type of reflector of the present invention is constructed by the method of manufacture in which a convex die is machined and thereafter the reflector is formed from the die.

In accordance with the above summary, the present invention achieves the objective of providing an improved multi-faceted reflector which, for each facet, efficiently reflects incident light uniformly over an illuminated area. The foregoing and other objects, features and embodiments are described in more detail in conjunction with the accompanying drawings.

DETAILED DESCRIPTION

Figure 1:
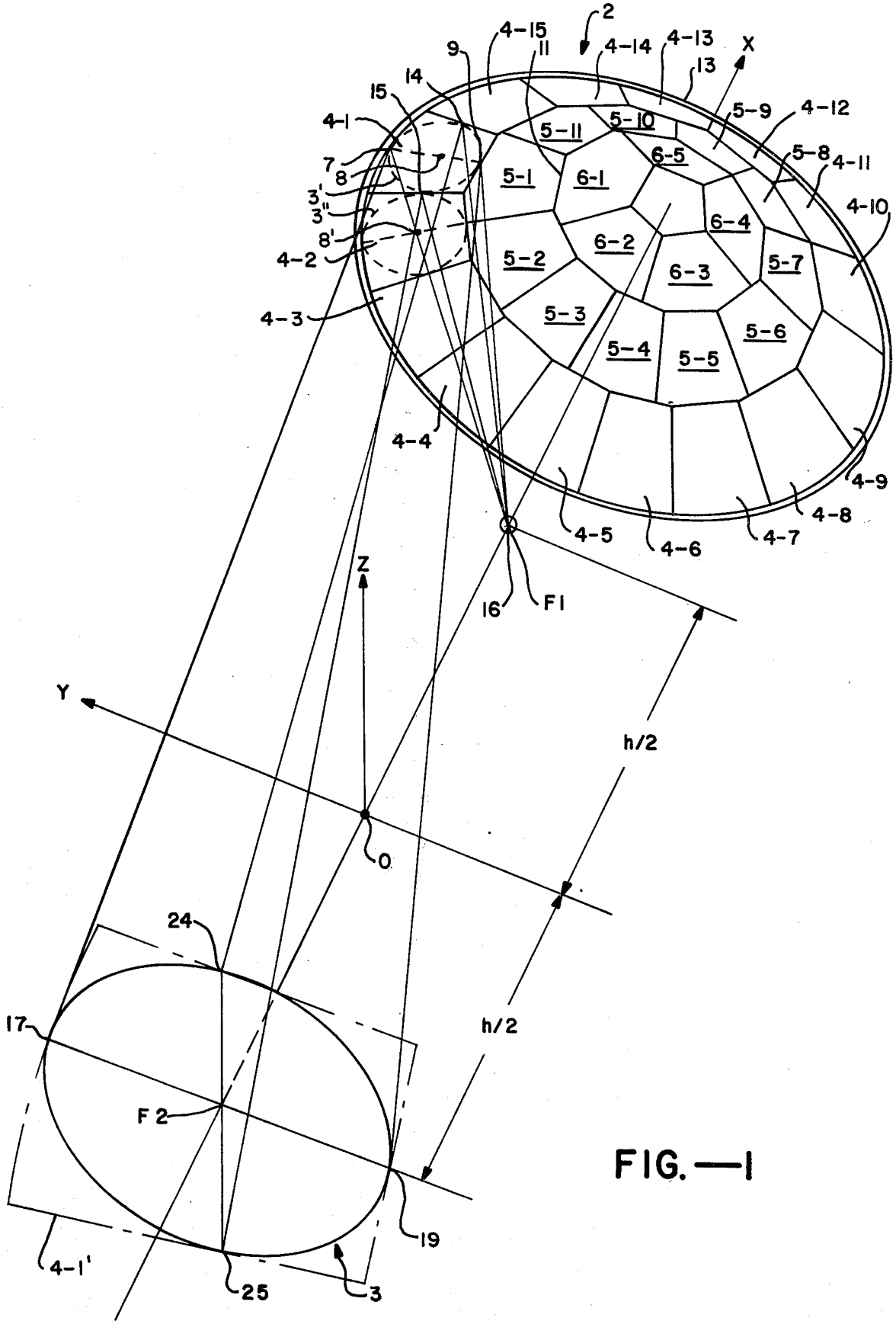
FIG. 1 depicts a perspective view of a multi-faceted reflector and light assembly positioned in an XYZ coordinate system to reflect light to a focused, illuminated plane in accordance with the present invention.

Perspective View — FIG. 1

Referring to FIG. 1, a multi-faceted reflector 2 is shown relative to an XYZ coordinate system with origin O. Reflector 2 reflects light from a light source 16 to an encompassing area 3. The reflector 2 is generally spheroid formed by an ellipse of revolution defined in terms of a fundamental ellipse (not shown in FIG. 1). The fundamental ellipse has foci F1 and F2 located along the X axis. The light source 16 is located at focus F1 and the illuminated area 3 appears on a plane passing through the focus F2 and normal to the X axis.

The reflector 2 is an embodiment which includes a plurality of facets. The facets are arranged in tiers. In the particular example of FIG. 1, three tiers of facets are shown. Specifically, the fifteen facets 4-1, 4-2, . . . , 4-15 appear in the outer tier. The eleven facets 5-1, 5-2, . . . , 5-11 appear in the next adjacent tier. Finally, the five facets 6-1, 6-2, . . . , 6-5 appear in the next adjacent tier which is the inner tier.

The facets 4-, 5-, and 6- of the reflector 2 are selected so that a substantial portion of the light incident from the light source 16 on each of the facets is reflected within the area 3.

Referring specifically to facet 4-1, the outer bound, measured in the XY plane of facet 4-1 is located at point 7. Light reflected from focus F1 to point 7 arrives at the boundary of area 3 at point 17. Similarly, the inner bound 9 of facet 4-1 reflects light incident from F1 to point 19 on the boundary of area 3. Therefore, the extreme bounds 7 and 9 of facets 4-1 also define the extreme bounds 17 and 19 of the area 3.

In a similar manner, the extreme bounds of the facet 4-1 measured in the direction of the X and Z axes are the points 14 and 15. Light incident from F1 on the point 15 arrives at the point 25 on area 3. Points 24 and 25 define the bounds of the area 3 in the XZ plane.

While the facet 4-1 has been described in detail in terms of its boundary points, each of the other facets 4-, 5-, and 6- in FIG. 1 similarly have bounds which cause light from focus F1 to reflect and to coalesce within the boundary of the area 3.

Figure 2:
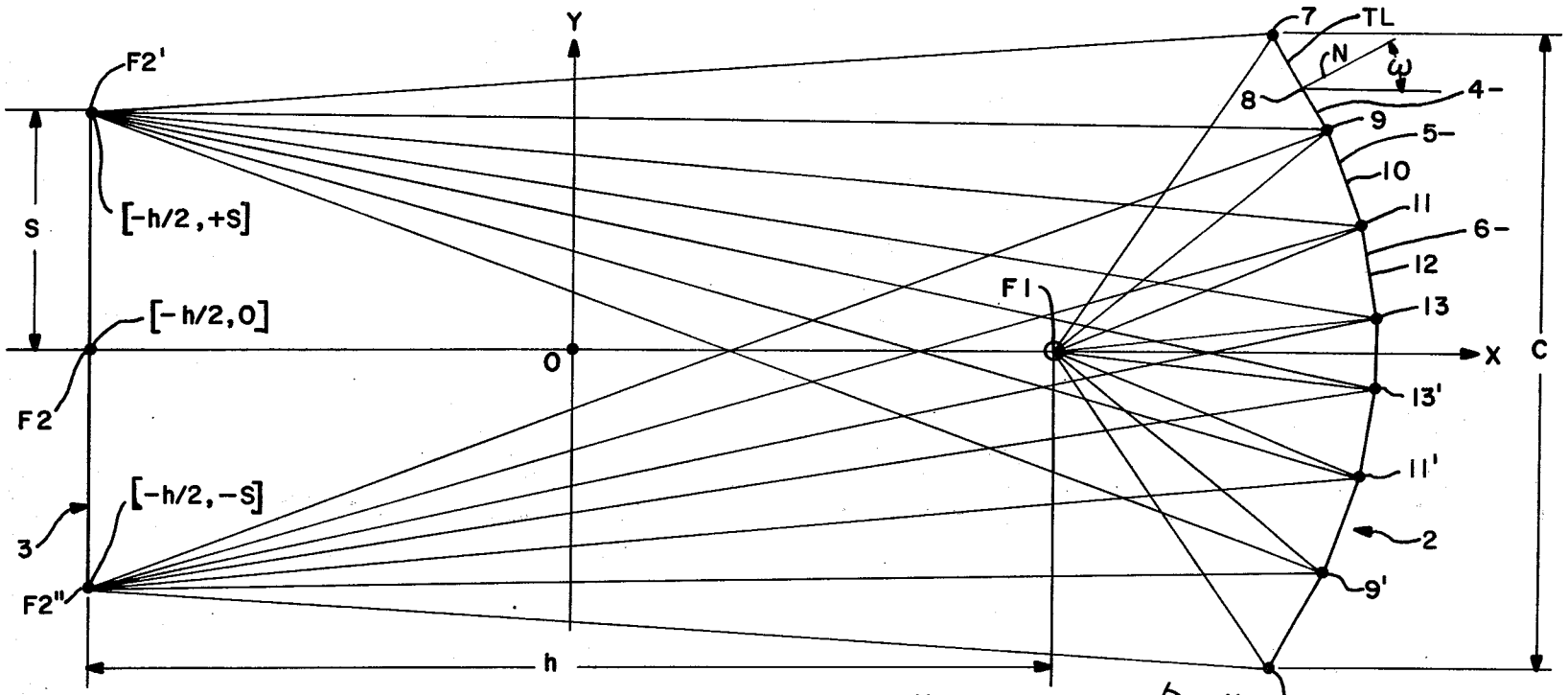
FIG. 2 depicts a side view of the reflector and image plane of FIG. 1 shown along the Z axis in the XY plane.

XY Plane View — FIG. 2

In FIG. 2, a side view in the XY plane of the reflector 2 and the image 3 of FIG. 1 is shown. The three tiers of facets 4-, 5-, and 6- each form a different angle with the XY plane. The reflector 2 has a maximum diameter, C.

In FIG. 2, the segment between points 7 and 9 is seen as a line which is in the plane of the facet 4-1 (see FIG. 1). The line between points 7 and 9 is referred to as the tangent line (TL). The line TL is tangent at point 8 to a fundamental ellipse (not shown in FIG. 2) which is utilized in determining the coordinates of the boundary points 7 and 9. The line TL makes an angle $\omega$ with the normal line N wich is perpendicular to line TL at point 8. The slope of the line TL is equal to $(90 - \omega)$ relative to the XY axes.

In a manner similar to the line between points 7 and 8, the line between points 9 and 11 and the line between points 11 and 13 also define tangent lines, each of which has a different slope, that is, each has a different value of $\omega$.

In FIG. 2, the focus, F1, is located at the X coordinate $+h/2$ and the Y coordinate 0 which is written as follows: $[+h/2,0]$. Similarly, the image area 3 is located in a plane normal to the XY plane and passing through the focus F2. The focus F2 has coordinates $[-h/2,0]$. The positive Y axis bound for the image area 3 is a focus F2', whose coordinates are $[-h/2,+s]$. The negative Y axis bound for the image area 3 is a focus F2'', whose coordinates are $[-h/2,-s]$.

In order to construct the reflector 2 such that each of the facets 4-, 5-, and 6-, reflect light within the boundaries of F2' and F2,'' the XY coordinates of the points 7, 9, 11 and 13 must be determined. When they are properly determined, the one of the facets 4- which contains the tangent line TL between the points 7 and 9 will reflect light between the points F2' and F2''. Specifically, light from F1 incident at point 7 will arrive at point F2'. Similarly, light from F1 to point 9 on one of the facets 4- will be reflected to point F2''.

In a similar manner, light from F1 incident on the point 9 of one of the facets 5- will be reflected to the point F2'. Light from F1 incident to point 11 of one of the facets 5- is reflected to point F2''. As is apparent from the above description, the point 9 of intersection between the facets 4- and 5- reflects light either to point F2' or to point F2'' depending on the angle $\omega$ of the facet. The facets 4- have angles $\omega$ different from the angles of facets 5- and the facets 6-.

With the above conditions explained, the next step is to determine the XY coordinates of the points 7, 8, 9, 10, 11, 12 and 13 as a function of the pre-selected parameters of the light assembly.

The pre-selected parameters of the light assembly are the maximum diameter, C, the distance, h, between the foci F1 and F2, the illuminated area size as defined by the area radius, s, and the slope $(90 - \omega)$, of the outer tier of facets. As an alternative to the slope, the distance from the light source to the rear of the reflector could have been selected.

With these pre-selected parameters, the XY coordinates of the points 7, 8, 9, 10, 11, 12 and 13 are calculated in the following manner. The parameters of the fundamental ellipse, E, which has foci at F1 and F2 and which is tangent to the tangent line TL at point 8 are determined. The X axis coordinate of the point 8 is equal to w and the Y axis coordinate of the point 8 is equal to z. First, the coordinates of point 7 are determined utilizing a rotated and expanded ellipse, E', which has foci F1 and F2' and which is tangent to the tangent line TL at point 7. The coordinates for point 7 for the X axis is $x_1$ and the coordinate of point 7 for the Y axis is $y_1$ where $y_1$ equals C/2. From this solution, the parameters of the fundamental ellipse are derived.

The XY axis coordinates $(x_2,y_2)$ of the point 9 are determined by rotating and expanding the fundamental ellipse E to form a rotated ellipse E'' having foci F1 and F2'' and which is tangent to the line TL at point 9.

After determining the coordinates of the points 7, 8, and 9 the process is again repeated for the points 10 and 11 with respect to the second tier of facets 5-. Thereafter, the process is again repeated for the points 12 and 13 for the third tier of facets 6-. The manner in which the successive XY axis coordinates of the points 7, 8, 9, 10, 11, 12 and 13 are determined is explained with reference to FIG. 3 in which the fundamental ellipse E and the rotated ellipses E′ and E″ are shown.

Determination of Successive XY Axes Coordinates

Figure 3:
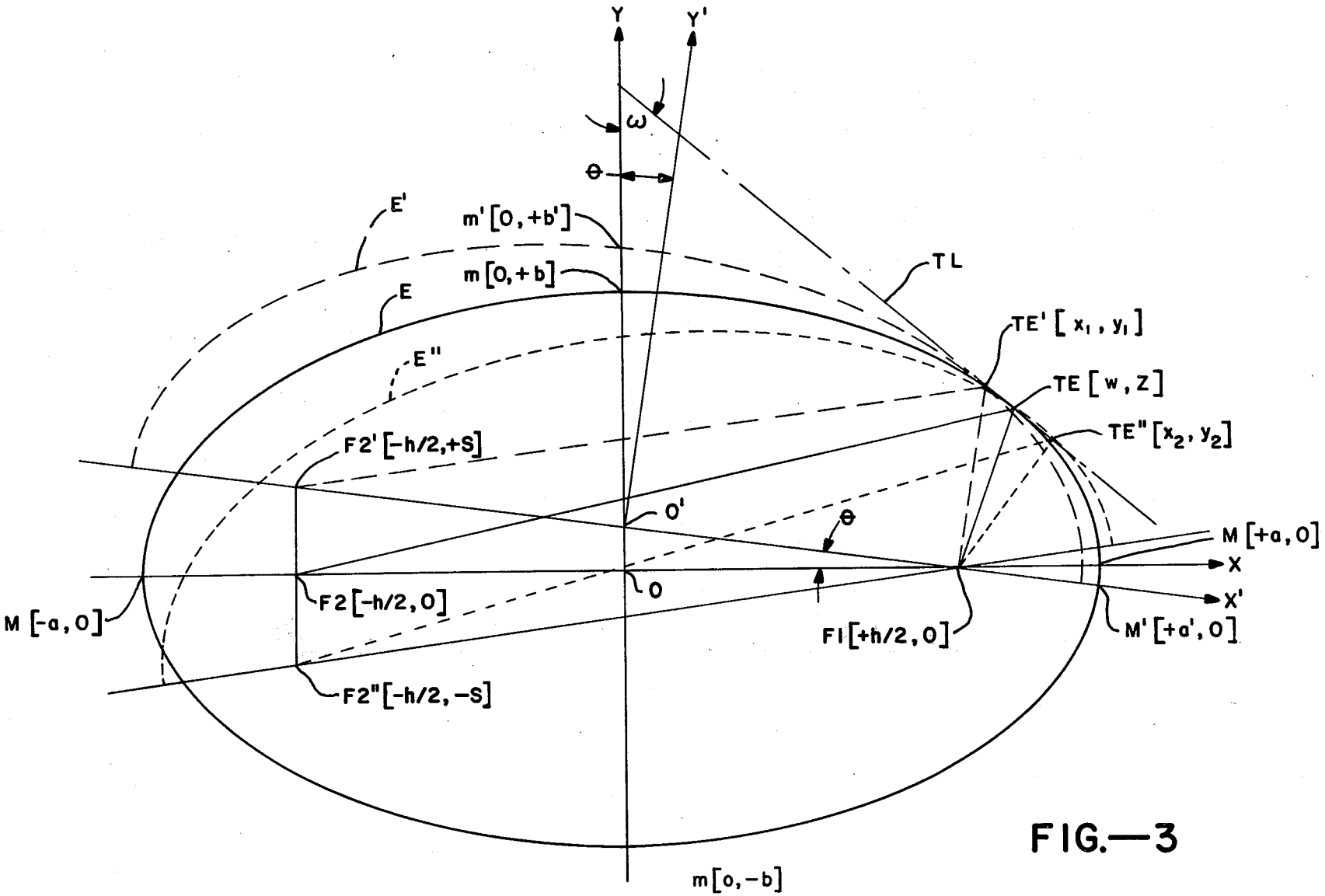
FIG. 3 depicts the fundamental ellipse and rotated and expanded ellipses which are utilized to calculate the outer bounds of each facet in the XY plane for the reflector of FIG. 1.

In FIG. 3, X,Y coordinate system with origin O is shown with the three ellipses E, E′ and E″. The ellipse, E, has foci at F1 having coordinates (+h/2,0) and at F2 having coordinates (−h/2,0). The ellipse, E, has foci separation of a distance h, has major axis coordinates of M(+a,0) and M(−a,0), and has minor axis coordinates of m(0,b) and m(0,b). The major axis length is $2a$ and the minor axis length is $2b$. Ellipse, E, has a tangent line TL tangent to E at the tangent point TE having coordinates (w,z). Line TL has a slope $-1/\tan\omega$.

A second ellipse, E′, is formed by rotating and expanding E upward about F1 such that its major axis passes through the point F2′ at (−h/2,+s). The rotated ellipse E′ has foci at F and F2′ and is tangent to the tangent line TL at point TE′, having coordinates ($x_1$, $y_1$). The ellipse E′ is shown in FIG. 3 relative to the axis X′ and Y′ which are translated in the direction of Y by +s/2 to a new origin O′, and rotated $\theta$ about O′ relative to X,Y.

A third ellipse, E″, is formed by rotating and expanding E downward about F1 such that its major axis passes through the point F2″ and (−h/2,−s). The rotated ellipse E″ has foci at F1 and F2″ and is tangent at point TE″ (having coordinates ($x_2$,$y_2$)) to the tangent line TL of the non-rotated ellipse E.

With a light source positioned at focus F1, all rays emitted from F1 and reflected by the tangent line between points TE′ and TE will pass through the segment between F2′ and F2, that is, the segment between coordinates (−h/2,+s) and (−h/2,0). Similarly, rays reflected between TE and TE″ will pass through the segment between F2 and F2″, that is, the segment between (−h/2,0) and (−h/2,−S).

The ellipse, E, is defined as the focus of points (x,y) as follows:

$$\frac{x^2}{a^2}+\frac{y^2}{b^2}=1 \qquad \text{Eq.(1)}$$

The tangent line TL of ellipse E is defined by the points (x,y) on the ellipse and any point such as ($x_1$,$y_1$) outside the ellipse and on TL as follows:

$$\frac{x_1x}{a^2}+\frac{y_1y}{b^2}=1 \qquad \text{Eq.(2)}$$

The objective is to solve Eq. (1) and Eq. (2) simultaneously for x and y to obtain the coordinate (w,z) of the point TE in terms of the basic ellipse parameters and another point on the line TL tangent with ellipse E. From Eq. (1), $$y=\sqrt{b^2-x^2b^2/a^2} \qquad \text{Eq. (3)}$$

From Eq. (2), $$x=\frac{a^2}{x_1}\left(1-\frac{y_1y}{b^2}\right)=w \qquad \text{Eq.(4)}$$

Substituting Eq. (4) into Eq. (3) yields, $$y^2\left(1+\frac{a^2y_1^2}{x_1^2b^2}\right)-\frac{2a^2y_1}{x_1^2}y+\left(\frac{a^2b^2}{x_1^2}-b^2\right)=0 \qquad \text{Eq.(5)}$$

Solving Eq. (5) for y yields the y coordinate, y = z, of the tangent point TE as follows:

$$y=\frac{a^2y_1\pm x_1\sqrt{b^2x_1^2-a^2b^2+a^2y_1^2}}{x_1^2+y_1^2\frac{a^2}{b^2}}=z \qquad \text{Eq.(6)}$$

All points external to and on tangent lines to the ellipse result in real values of Eq. (6). Only first quadrant values of X and Y are selected. Understanding that the value of y of Eq. (6) is utilized in Eq. (4), the X coordinate, x = w, of the tangent point TE is given as follows:

$$x=(a^2/x_1)(1-y_1y/b^2)=w \qquad \text{Eq. (7)}$$

The rotated ellipse E′ is defined with respect to the rotated coordinate system X′,Y′ where E′ has major and minor axis coordinates a′ and b′ respectively. Each point (x′,y′) on rotated ellipse E′, relative to the rotated axes, is therefore defined by the rotated ellipse equation as follows:

$$\frac{x'^2}{a'^2}+\frac{y'^2}{b'^2}=1=\frac{b'^2x'^2+a'^2y'^2}{a'^2b'^2} \qquad \text{Eq.(8)}$$

The point ($x_1$,$y_1$) is defined to be the tangent point TE′ of line TL and the rotated ellipse E′. Using the point (w,z) on the ellipse E to define the values of x and y in Eq. (2), the tangent line TL can be defined as follows:

$$\frac{x_1w}{a^2}+\frac{y_1z}{b^2}-1 \qquad \text{Eq.(9)}$$

Before Eq. (8) and Eq. (9) can be simultaneously solved for the x and y coordinates, $x_1$ and $y_1$, of the tangent point TE′, the equations must be rewritten relative to the same system of axes. In FIG. 3, the axes X′ and Y′ are shifted +s/2 in the y direction and then rotated clockwise by an angle $\theta$ relative to the origin O of the X and Y axes.

In FIG. 3, the angle of rotation $\theta$ is defined as follows:

$$\tan\theta=s/h \qquad \text{Eq. (10)}$$

Therefore, $$\sin\theta=-s/(h^2+s^2) \qquad \text{Eq. (11}a\text{)}$$

$$\cos\theta=h/(h^2+s^2) \qquad \text{Eq. (11}b\text{)}$$

The relationship of variables x′ and y′ of a coordinate system (not shown) rotated by $\theta$ (without translation) relative to variables x and y in a non-rotated system are well known as follows:

$$x'=x\cos\theta-y\sin\theta \qquad \text{Eq. (12)}$$

$$Y'=x\sin\theta+y\cos\theta \qquad \text{Eq. (13)}$$

Because the X',Y' coordinate system of FIG. 3 is also translated by s/2, the value of y in Eq. (12) and Eq. (13) becomes $(y - s/2)$. Substituting $y = (y - s/2)$ in Eq. (12) and Eq. (13) yields the translated and rotated equations relating the coordinates in the two systems of axes as follows:

$$x' = x\cos\theta - (y - s/2)\sin\theta \qquad \text{Eq. (14)}$$

$$y' = x\sin\theta + (y - s/2)\cos\theta \qquad \text{Eq. (15)}$$

Substituting Eq. (11a) and Eq. (11b) into Eq. (14) and Eq. (15) yields, $$x' = \frac{hx}{\sqrt{h^2+s^2}} - \frac{sy}{\sqrt{h^2+s^2}} + \frac{s^2}{2\sqrt{h^2+s^2}} = \frac{hx - sy + \frac{s^2}{2}}{\sqrt{h^2+s^2}} \qquad \text{Eq. (16)}$$

$$y' = \frac{sx}{\sqrt{h^2+s^2}} + \frac{hy}{\sqrt{h^2+s^2}} - \frac{sh}{2\sqrt{h^2+s^2}} = \frac{sx + hy - \frac{sh}{2}}{\sqrt{h^2+s^2}} \qquad \text{Eq. (17)}$$

The tangent line TL is a line of the following form, $$y = -(dy/dx)x + \epsilon \qquad \text{Eq. (18)}$$

Also, the determination of both the slope dy/dx and the y intercept $\epsilon$ in Eq. (18) may be carried out by defining the tangent line TL in terms of the rotated coordinate system using ellipse E'. In this determination, $x_1'$ and $y_1'$ are two variables defining the point on TL in the rotated coordinate system but are not on ellipse E', and where x' and y' are on the ellipse E'. With these definitions, TL is defined as follows:

$$y' = \frac{-b'^2}{a'^2}\,\frac{x_1' x'}{y_1'} + \frac{b'^2}{y_1'} \qquad \text{Eq. (19)}$$

In Eq. (19), the values of x', and y', are substituted with Eq. (16) and Eq. (17), respectively, wherein in Eq. (16) and Eq. (17) x is equal to $x_1$ and y is equal to $y_1$. With these substitutions Eq. (19) becomes after solving for y as follows, $$y = -\frac{b'^2h\left(hx_1 - sy_1 + \frac{s^2}{2}\right) + a'^2s\left(sx_1 + hy_1 - \frac{sh}{2}\right)}{a'^2h\left(sx_1 + hy_1 - \frac{sh}{2}\right) - b'^2s\left(hx_1 - sy_1 + \frac{s^2}{2}\right)} \times + \frac{a'^2b'^2(h^2+s^2)}{a'^2h\left(sx_1 + hy_1 - \frac{sh}{2}\right) - b'^2s\left(hx_1 - sy_1 + \frac{s^2}{2}\right)} + \frac{s}{2} \qquad \text{Eq. (20)}$$

In Eq. (20), the values of the slope dy/dx and $\epsilon$ for the tangent line TL are evident. The same tangent line TL is defined in terms of Eq. (9) rewritten as follows, $$y_1 = -\frac{b^2w}{a^2z}x_1 + \frac{b^2}{z} \qquad \text{Eq. (21)}$$

The two definitions of the slope of the single line TL, as defined by Eq. (20) and Eq. (21), are equated as follows:

$$\frac{b^2w}{a^2z} = \frac{b'^2h\left(hx_1 - sy_1 + \frac{s^2}{2}\right) + a'^2s\left(sx_1 + hy_1 - \frac{sh}{2}\right)}{a'^2h\left(sx_1 + hy_1 - \frac{sh}{2}\right) - b'^2s\left(hx_1 - sy_1 + \frac{s^2}{2}\right)} \qquad \text{Eq. (22)}$$

The two definitions of the intercept on the Y axis of line TL, as defined by Eq. (20) and Eq. (21), are equated as follows:

$$\frac{b^2}{z} = \frac{a'^2b'^2(h^2+s^2)}{a'^2h\left(sx_1 + hy_1 - \frac{sh}{2}\right) - b'^2s\left(hx_1 - sy_1 + \frac{s^2}{2}\right)} + \frac{s}{2} \qquad \text{Eq. (23)}$$

Solving Eq. (22) and Eq. (23) simultaneously yields, $$a'^2 = \frac{a^2\left(b^2 - z\frac{s}{2}\right)\left(hx_1 - sy_1 + \frac{s^2}{2}\right)}{(b^2wh - a^2zs)} \qquad \text{Eq. (24)}$$

$$b'^2 = \frac{a^2\left(b^2 - z\frac{s}{2}\right)\left(sx_1 + hy_1 - \frac{sh}{2}\right)}{(a^2zh + b^2ws)} \qquad \text{Eq. (25)}$$

Eq. (24) and Eq. (25) are the statements defining the major axis a' and minor axis b' intercepts of the rotated ellipse E' of FIG. 3.

The distance, D(F1,F2'), between the foci F1 and F2' in FIG. 3 is known by the Pythagorean theory to be as follows:

$$D(F1,F2') = \sqrt{h^2+s^2} \qquad \text{Eq. (26)}$$

Also, the foci separation D(F1,F2') of any ellipse such as E' is well known as follows:

$$D(F1, F2') = 2(a'^2 - b'^2) \qquad \text{Eq. (27)}$$

Combining Eq. (26) and Eq. (27) yields, $$a'^2 - b'^2 = (h^2+s^2)/4 \qquad \text{Eq. (28)}$$

Substituting Eq. (24) and Eq. (25) into Eq. (28) yields, $$\frac{h^2+s^2}{4} = a^2\left(b^2 - z\frac{s}{2}\right)\left(\frac{hx_1 - sy_1 + \frac{s^2}{2}}{b^2wh - a^2zs} - \frac{sx_1 + hy_1 - \frac{sh}{2}}{a^2zh + b^2ws}\right) \qquad \text{Eq. (29)}$$

Solving Eq. (29) for $y_1$ yields, $$y_1 = \frac{a^2z}{b^2w}x_1 - \frac{(b^2wh - a^2zs)(a^2zh + b^2ws)}{4a^2b^2w\left(b^2 - z\frac{s}{2}\right)} + \frac{s}{2} \qquad \text{Eq. (30)}$$

The line of Eq. (30) passes through the point $(x_1,y_1)$ on the rotated ellipse E' having foci at (h/2,0) and (−h/2, + s). The point $(x_1,y_1)$ is also on the tangent line defined by Eq. (21) where that tangent line is tangent to the ellipse E having foci (h/2,0) and (−h/2,0) at point (w,z). Therefore, solving Eq. (30) and Eq. (21) simultaneously for $x_1$ and $y_1$ determines the values of $(x_1,y_1)$ as a function of the non-rotated ellipse parameters a and b, the translation and rotation determined by h and s, and tangent point (w,z), as follows:

$$x_1 = \frac{z\left(\frac{(b^2wh - a^2zs)(a^2zh + b^2ws)}{4\left(b^2 - z\frac{s}{2}\right)}\right) + a^2b^2w\left(b^2 - z\frac{s}{2}\right)}{a^4z^2 + b^4w^2} \quad \text{Eq. (31)}$$

$$y_1 = -\frac{b^2w}{a^2z}x_1 + \frac{b^2}{z} \quad \text{Eq. (32)}$$

For an ellipse E″ rotated and expanded to foci (+h/2,0) and (−h/2,−s), and for the tangent point TE″ having coordinates $(x_2,y_2)$ on the tangent line TL, the rotated ellipse coordinates of the tangent point TE″ are formed by substituting -s for s in Eq. (31) as follows:

$$x_2 = \frac{z\left(\frac{(b^2wh + a^2zs)(a^2zh - b^2ws)}{4\left(b^2 + z\frac{s}{2}\right)}\right) + a^2b^2w\left(b^2 + z\frac{s}{2}\right)}{a^4z^2 + b^4w^2} \quad \text{Eq. (33)}$$

$$y_2 = -\frac{b^2w}{a^2z}x_2 + \frac{b^2}{z} \quad \text{Eq. (34)}$$

The above equations are useful in determining the coordinates of the points 7, 8, 9, 10, 11, 12 and 13 of the reflector 2 of FIG. 2. The actual solution of those equations is described hereinafter in connection with an exemplary computer program. Before the above equations can be solved, however, it is necessary to determine the parameters of the fundamental non-rotated ellipse.

Determination of Fundamental Non-Rotated Ellipse Parameters

Figure 4:
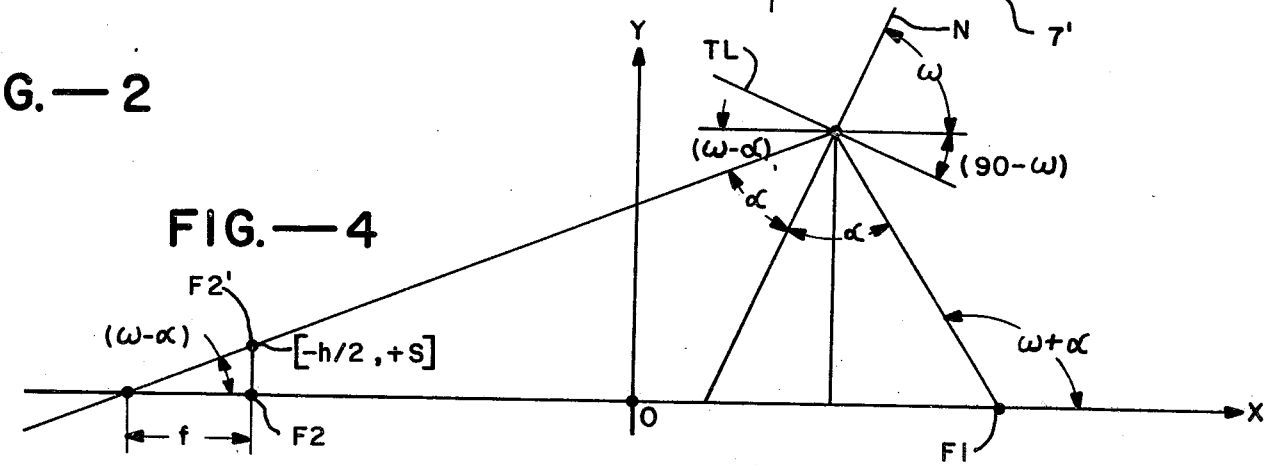
FIG. 4 depicts a view of a geometrical construction in the XY plane useful in calculating the parameters for the fundamental ellipse of FIG. 3.

To determine the parameters a and b of a non-rotated ellipse E for use to form a reflector having a desired reflector diameter C and an outer tangent slope −1/tan ω, consider the construction of FIG. 4 where ω is the angle between a line normal to TL and the x axis. In FIG. 4, it is apparent that ω is the angle that the line N normal to line TL makes with a line parallel to the X axis.

$$-1/\tan\omega = \tan(90 - \omega) \quad \text{Eq. (35)}$$

Where (ω + α) is the angle between the X axis and a line between F1 and $(x_1,y_1)$ and (ω − α) is the angle between F2′ and $(x_1,y_1)$ it is apparent from the construction of FIG. 4 that, $$\tan(\omega + \alpha) = \frac{y_1}{\left(x_1 - \frac{h}{2}\right)} \quad \text{Eq. (36)}$$

-continued $$\tan(\omega - \alpha) = \frac{s}{f} = \frac{y_1}{x_1 + \frac{h}{2} + f} \quad \text{Eq. (37)}$$

solving the right-hand Eq. (37) for f yields, $$f = \frac{x_1 + \frac{h}{2}}{\frac{y_1}{s} - 1} \quad \text{Eq. (38)}$$

Substituting Eq. (38) into the left-hand Eq. (37) yields, $$\tan(\omega - \alpha) = \frac{y_1 - s}{x_1 + \frac{h}{2}} \quad \text{Eq. (39)}$$

Solving Eq. (39) for tan α yields, $$\frac{\tan\omega - \tan\alpha}{1 + \tan\omega\tan\alpha} = \frac{y_1 - s}{x_1 + \frac{h}{2}} \quad \text{Eq. (40)}$$

$$\tan\alpha = \frac{\left(x_1 + \frac{h}{2}\right)\tan\omega - y_1 - s}{x_1 + \frac{h}{2} + (y_1 - s)\tan\omega} \quad \text{Eq. (41)}$$

Solving Eq. (36) for tan α yields, $$\frac{\tan\omega + \tan\alpha}{1 - \tan\omega\tan\alpha} = \frac{y_1}{x_1 - \frac{h}{2}} \quad \text{Eq. (42)}$$

$$\tan\alpha = \frac{y_1 - \left(x_1 - \frac{h}{2}\right)\tan\omega}{x_1 - \frac{h}{2} + y_1\tan\omega} \quad \text{Eq. (43)}$$

Equating tan α from Eq. (41) and Eq. (43) and solving for $x_1$ yields, $$x_1 = \frac{-(2y_1 - s)(\tan^2\omega - 1) \pm \sqrt{(2y_1 - s)^2(\tan^2\omega - 1)^2 - 8\tan[\omega 2\phi\tan\omega + (\tan^2\omega - 1)\frac{s}{2}]}}{4\tan\omega} \quad \text{Eq. (44)}$$

where in Eq. (44), φ is defined as follows:

$$\phi = -y_1^2 + sy_1 - (h^2/4) \quad \text{Eq. (45)}$$

If $y_1$ is the desired radius C/2 of the reflector, and tan ω is an arbitrarily sloped tangent line TL, then a solution for $a'^2$ and $b'^2$ of a rotated and translated ellipse is obtained where that ellipse is defined as follows, relative to rotated axes X′,Y′:

$$b'^2x'^2 + a'^2y'^2 = a'^2b'^2 \quad \text{Eq. (46)}$$

$$x'^2 = \alpha = \frac{h^2x_1^2 - 2hsx_1y_1 + hs^2x_1 + s^2y_1^2 - s^3y_1 + \frac{s^4}{4}}{h^2 + s^2} \quad \text{Eq. (47)}$$

$$y'^2 = \gamma = \frac{s^2x_1^2 + 2hsx_1y_1 - s^2hx_1 + h^2y_1^2 - sh^2y_1 + \frac{s^2h^2}{4}}{h^2 + s^2} \quad \text{Eq. (48)}$$

Also, the variable ρ is defined as follows, $$\rho = \frac{h^2 + s^2}{4} - \alpha - \gamma \qquad \text{Eq. (49)}$$

Also, in Eq. (46), the value of $a'^2$ is defined from Eq. (28) as follows:

$$b'^2 = a'^2 - (h^2 + s^2)/4 \qquad \text{Eq. (50)}$$

Solving Eq. (46) and Eq. (50) simultaneously for $b'^2$ and $a'^2$ and substituting the expressions of Eq. (47), Eq. (48) and Eq. (49) yields, $$b'^4 + \rho b'^2 - \frac{h^2 + s^2}{4}\gamma = 0 \qquad \text{(Eq. (51)}$$

Solving Eq. (51) for $b'^2$ yields, $$b'^2 = \frac{-\rho \pm \sqrt{\rho^2 + (h^2 + s^2)\gamma}}{2} \qquad \text{Eq. (52)}$$

With $b'^2$ known from Eq. (52), and assuming its positive values, then $a'^2$ is calculated from Eq. (50), as follows:

$$a'^2 = b'^2 + (h^2 + s^2)/4 \qquad \text{Eq. (53)}$$

The values of $b'^2$ and $a'^2$ of Eq. (52) and Eq. (53) will be used to calculate the values of a and b in order to define the non-rotated ellipse hereinafter.

From the non-rotated ellipse Eq. (1) and the construction of FIG. (3) with (w,z) a point on the ellipse E, substituting w and z into Eq. (1) and solving for w yields, $$w^2 = a^2(1 - z^2/b^2) \qquad \text{Eq. (54)}$$

Also, from the Eq. (21) expression for the tangent line TL, the value of the slope, $-1/\tan\omega$, is substituted for $-b^2w/a^2z$ as follows:

$$y_1 = -x_1/\tan\omega + b^2/z \qquad \text{Eq. (55)}$$

Solving Eq. (55) for z yields, $$z = \frac{b^2}{y_1 + x_1/\tan\omega} \qquad \text{Eq. (56)}$$

From the right-hand side of Eq. (30), the Y axis intercept of the line TL, in terms of the rotated ellipse parameters, is given. Letting the right-hand side of Eq. (23) equal $\epsilon$ yields, $$\epsilon = \frac{a'^2b'^2(h^2 + s^2)}{a'^2h\left(sx_1 + hy_1 - \frac{sh}{2}\right) - b'^2s\left(hx_1 - sy_1 + \frac{s}{2}\right)} + \frac{s}{2} \qquad \text{Eq. (57)}$$

Using the slope, dy/dx, to be equal to $-1/\tan\omega$, Eq. (18) becomes $$y = -x/\tan\omega + \epsilon \qquad \text{Eq. (58)}$$

One point on the tangent line of Eq. (57) is the point (w,z) so that Eq. (58) becomes $$z = -w/\tan\omega + \epsilon \qquad \text{Eq. (59)}$$

Substituting w from Eq. (54) into Eq. (58) yields, $$z = \frac{a\sqrt{1 - z^2/b^2}}{\tan\omega} + \epsilon \qquad \text{Eq. (60)}$$

From a well-known property of an ellipse, it can be shown that, $$a = \sqrt{\frac{h^2}{4} + b^2} \qquad \text{Eq. (61)}$$

Using Eq. (61) for a in Eq. (60) and transposing yields, $$z - \epsilon = \sqrt{\frac{(h^2/4 + b^2)(1 - z^2/b^2)}{\tan\omega}} \qquad \text{Eq. (62)}$$

Squaring Eq. (62) yields, $$z^2 - 2z\epsilon + \epsilon^2 = (1/\tan^2\omega)(h^2/4 + b^2)(1 - z^2/b^2) \qquad \text{Eq. (63)}$$

Substituting z from Eq. (56) into Eq. (63) yields, $$\frac{b^4}{\left[Y_1 + \frac{x_1}{\tan\omega}\right]^2}\left[\frac{h^2}{4b^2} + \tan^2\omega + 1\right] = 2\epsilon\tan^2\omega\,\frac{b^2}{\left[Y_1 + \frac{x_1}{\tan\omega}\right]} \qquad \text{Eq. (64)}$$

Solving Eq. (64) for $b^2$ yields, $$b^2 = \frac{\psi \pm \sqrt{\psi^2 + 4\xi(\tan^2\omega + 1)\left[\frac{h^2}{4} - \epsilon^2\tan^2\omega\right]}}{2(\tan^2\omega + 1)} \qquad \text{Eq. (65)}$$

where $$\psi = 2\epsilon(y_1\tan^2\omega + X_1\tan\omega) - \frac{h^2}{4} + \xi \qquad \text{Eq. (66)}$$

$$\xi = y_1^2 + \frac{2x_1y_1}{\tan\omega} + \frac{x_1^2}{\tan^2\omega} \qquad \text{Eq. (67)}$$

Using a positive value, $(b+)$, of b from Eq. (65) in Eq. (61) yields, $$a = \sqrt{\frac{h^2}{4} + (b+)^2} \qquad \text{Eq. (68)}$$

The above equations define the XY axes bounds of the facets in each of the tiers of the reflector 2 of FIGS. 1 and 2. The task remains to define the XZ axes coordinates of the facets. For example, with respect to the facet 4-1 in FIG. 1, the XZ axes coordinates of the points 14 and 15 must be defined.

Determination of XZ Axes Coordinates

Figure 5:
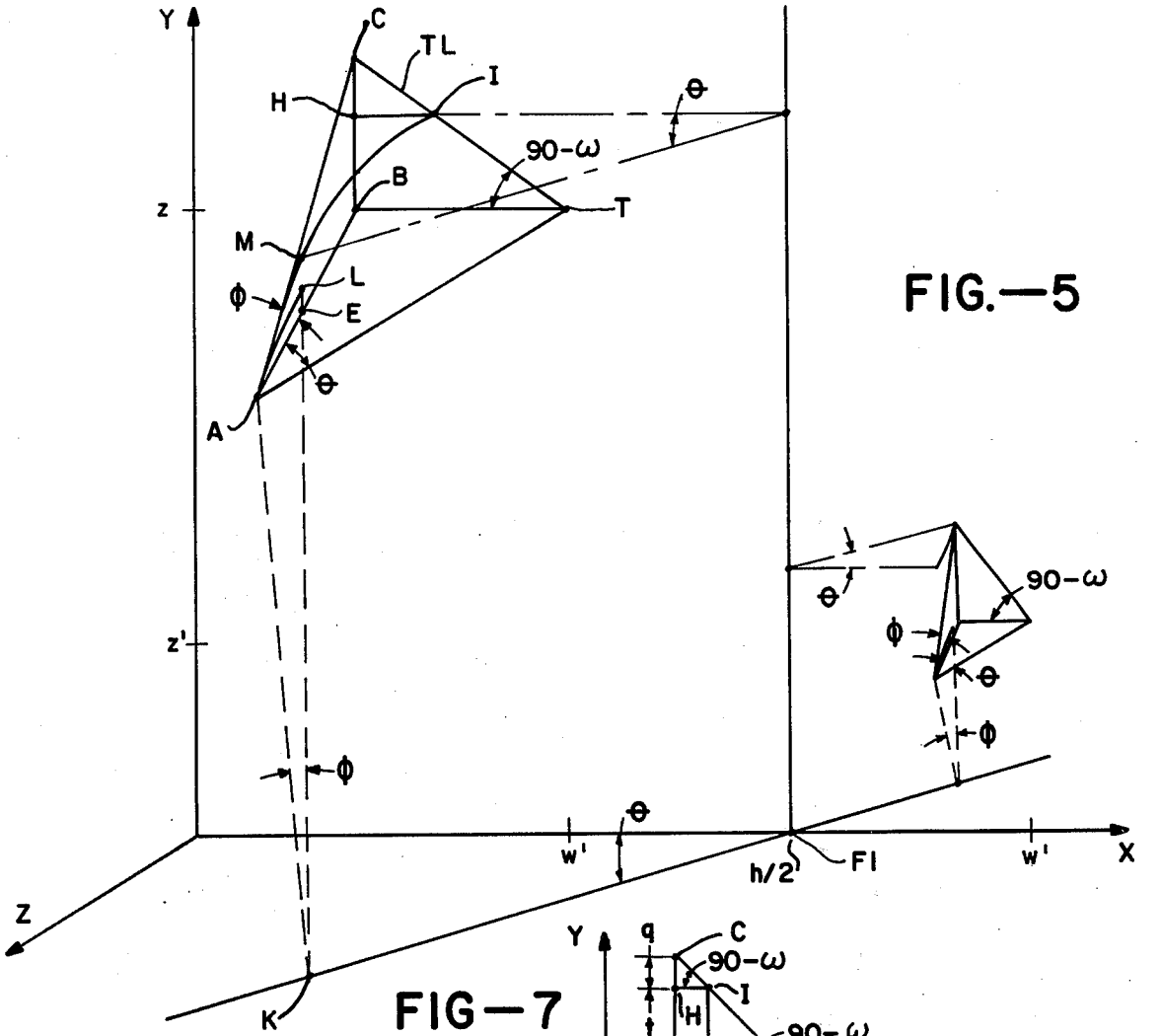
FIG. 5 is a perspective view of a geometrical construction useful in calculating the extreme bounds in the XZ plane of the facets for the reflector of FIG. 1.

The determination of XZ axes coordinates is carried out with reference to FIGS. 5, 6, 7 and 8. In FIG. 5, a perspective view of an XYZ axes system is shown in which the point T has an X axis coordinate w, a Y axis coordinate z and a Z coordinate 0. Point T, therefore, is analogous to the tangent point 8 in FIG. 2. The difference between point T in FIG. 5 and the point 8 in FIG. 2 is in that the X axis coordinate w in FIG. 2 is greater than h/2 (the coordinate of F1), while in FIG. 5 the X axis coordinate w is less than h/2. The results of the subsequent derivation are identical whether or not w' (a point in FIG. 5 greater than h/2) or w is the X axis coordinate for the point T.

In FIG. 5, line AT is parallel to the Z axis and in the plane of the facet. Point A is located by rotating the XY plane about F1 parallel to the Y axis and then rotating about the line formed by the intersection of this rotated plane with the XZ plane so that a tangent plane to an ellipse in that plane would be parallel to the original tangent plane, that is, the plane containing the line TL and normal to the XY plane.

In FIG. 5, the line T-C is equivalent to the tangent line TL in FIG. 2. A perpendicular from the point B to the point C forms a right triangle T-C-B which is entirely within the XY plane.

From FIG. 6, it is apparent that the segment between F1 and E has the same length as the segment F1 and G along the X axis and is defined as follows:

$$F1 - G = h/2 - w + t' + j' \quad \text{Eq. (69)}$$

Observing in FIG. 6 the right triangle F1-E-D the leg D-E has a length, d, as follows:

$$d = (h/2 - W + t' + j') \sin \theta \quad \text{Eq. (70)}$$

Observing in FIG. 6 the right triange E-D-B, the leg B-D has a length, n, and the leg B-E has a length, r, as follows:

$$n = (d) \tan \theta \quad \text{Eq. (71)}$$

$$r = d/\cos \theta \quad \text{Eq. (72)}$$

Observing in FIG. 6 the triangle T-A-B, the leg T-A has length p, as follows:

$$p = s + d \quad \text{Eq. (73)}$$

Figure 6:
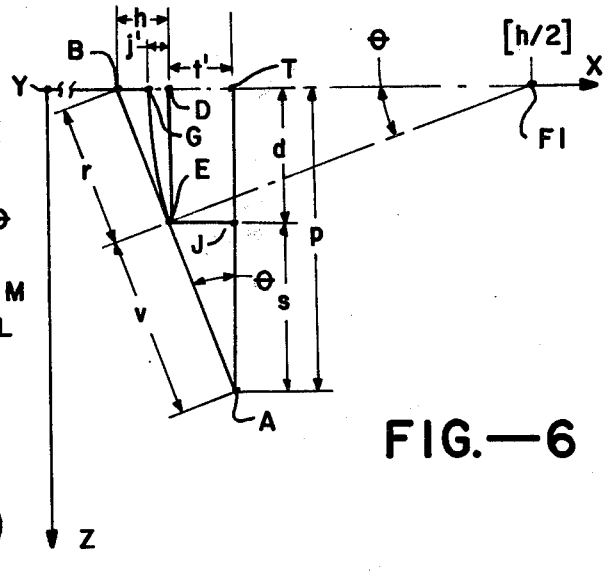
FIG. 6 is a bottom view of the geometrical construction of FIG. 5 taken in the XZ plane.

Observing in FIG. 6 the triangle F1-E-D, the leg F1-D has a length equal to the product of F1-G (which is defined by Eq. (69) and cos $\theta$, and therefore j' which is the difference between F1-D and F1-G is defined as follows:

$$j' = (h/2 - w + t' + j')(1 - \cos \theta) \quad \text{Eq. (74)}$$

$$j' = (h/2 - w + t')(1 - \cos \theta)/\cos \theta \quad \text{Eq. (75)}$$

Observing in FIG. 6 the triangle A-E-J, the leg J-E has a length, t' and the leg J-A has a length, s, defined as follows:

$$t' = (v) \sin \theta \quad \text{Eq. (76)}$$

$$s = (v) \cos \theta \quad \text{Eq. (77)}$$

Figure 7:
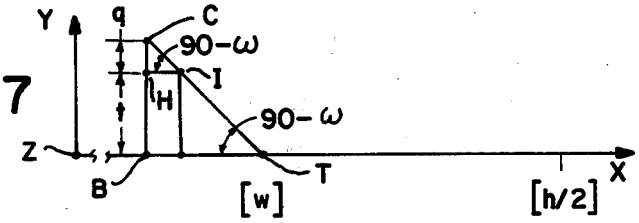
FIG. 7 is a front view of the geometrical construction of FIG. 5 taken in the XY plane.

Observing in FIG. 7 the right triangle C-H-I, the leg C-H has a length, q, as follows:

$$q = (m) \cot \omega \quad \text{Eq. (78)}$$

Figure 8:
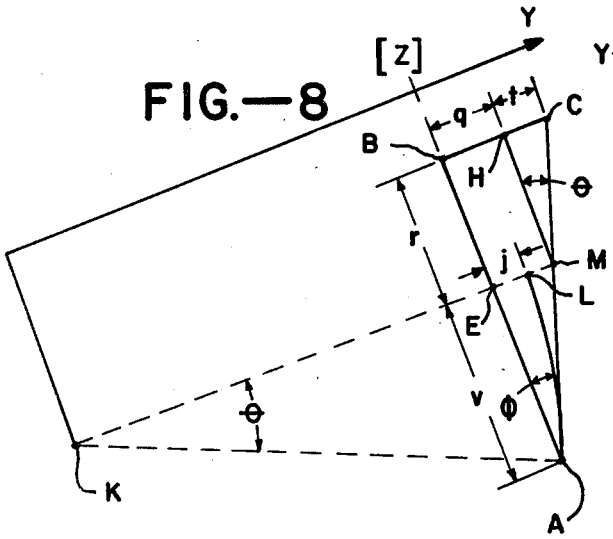
FIG. 8 is a view of the geometrical construction of FIG. 5 taken in the ABCK plane.

Observing in FIG. 8 the triangle A-K-E, the leg A-K has a length equal to the length of the segment K-L which is equal to z+j so that the length v, of the segment A-E of triangle A-E-K is as follows:

$$v = (z + j) \sin \phi \quad \text{Eq. (79)}$$

$$v = (z) \tan \phi \quad \text{Eq. (80)}$$

Observing in FIG. 8 the triangle A-E-M, the leg E-M has a length g defined as follows:

$$q = (r) \tan \phi \quad \text{Eq. (81)}$$

Similar to the derivation of j' in Eq. (74), the segment E-L in FIG. 8 has a length j as follows:

$$j = (z + j)(1 - \cos \phi) \quad \text{Eq. (82)}$$

$$j = (z)(1 - \cos \phi)/\cos \phi \quad \text{Eq. (83)}$$

Substituting Eq. (75) into Eq. (70) yields, $$d = (h/2 - w + t') \sin \theta/\cos \phi \quad \text{Eq. (84)}$$

Substituting Eq. (76) into Eq. (84) and changing form yields, $$d = (h/2 - w + (v) \sin \theta) \tan \theta \quad \text{Eq. (85)}$$

Substituting Eq. (85) into Eq. (71) and thereafter substituting the result into Eq. (78) yields, $$q = (h/2 - w + (v) \sin \theta) \tan^2 \theta \cot \omega \quad \text{Eq. (86)}$$

Substituting Eq. (85) into Eq. (72) yields, $$r = (h/2 - w + (v) \sin \theta) \tan \theta/\cos \theta \quad \text{Eq. (87)}$$

Substituting Eq. (86) and Eq. (87) into Eq. (81) and changing form yields, $$\tan \phi = q/r = \cos \theta \tan \theta \cot \omega \quad \text{Eq. (88)}$$

$$\tan \phi = \sin \theta \cot \omega \quad \text{Eq. (89)}$$

Substituting Eq. (80) into Eq. (85) yields $$d = (h/2 - w + z\tan \phi \sin \theta \gamma \tan \theta \quad \text{Eq. (90)}$$

Substituting Eq. (80) into Eq. (77) yields $$s = z \tan \phi \cos \theta \quad \text{Eq. (91)}$$

Substituting Eq. (90) and Eq. (91) into Eq. (73) yields, $$p = s+d = z \tan \phi \cos \theta + (h/2 - w+z \tan \phi \sin \theta) \tan \theta \quad \text{Eq. (92)}$$

Substituting Eq. (89) into Eq. (92) yields $$p = s+d = z \sin \theta \cot \omega \cos \theta + (h/2-w+z \sin^2 \theta \cot\omega) \tan \theta \quad \text{Eq. (93)}$$

Eq. (93) defines the calculated length of one-half of the facet 4-1 in FIG. 1. The calculated width of the whole facet, between points 14 and 15 in FIG. 1, is therefore 2p. As will be described hereinafter in connection with FIG. 10, however, the calculated dimension 2p is modified in order to have an integral number of equal width facets in a tier.

Computer Program

The following TABLE I, including program statements S1 through S85, is a typical program for forming milling coordinates defining a reflector in accordance with the present invention.

Figure 9:
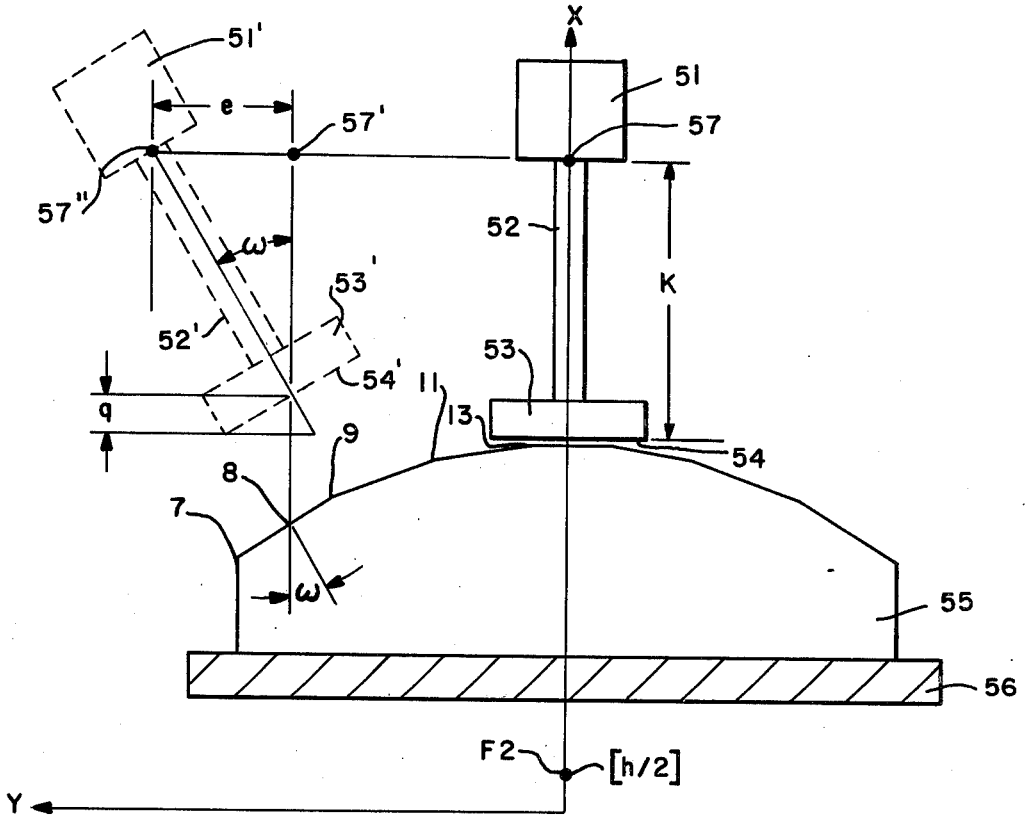
FIG. 9 depicts a view in the XY plane of a milling machine positioned to mill a convex die useful in manufacturing the concave reflector of FIG. 1.

In S1, the parameters employed in execution of the program are identified. The parameter K is a characteristic of the milling machine and is the distance from the rotation point to the cutting surface as shown in FIG. 9. The parameter H is the value, h, which is shown in FIGS. 1 and 2 as the distance between foci. The parameter C is the maximum diameter of the reflector as indicated in FIG. 2. The parameter S corresponds to the radius, s, of the illuminated area as shown in FIG. 2. The parameter B corresponds to the minor axis intercept, b, of the ellipse as indicated in FIG. 3. The parameter D is the distance from focus F1 to the axis intercept near the center point of the reflector that is apparent in FIG. 2. The parameters X(10) and the parameters Y(10) are sets of variables used in calculating the X,Y coordinates. The parameter W is the X axis value at the facet end-points of the reflector. The parameter DEL is a number equal to the TAN $\omega$ where $\omega$ is the angle indicated in FIG. 2. The parameter THAT is the angle $\theta$ which has an arc tangent S/H. The parameter SY is the angle $\phi$ explained in connection with Eq. (89). The parameter T is the slope in radians of the tangent line TL. The parameter J is a program control index number which indicates the number of reflector designs to be processed during execution and which terminates the program.

In S2, the card reader defined by IRDR is set equal to one for format statements.

In S3, the printer defined by IPTR is set equal to three for format statements.

The S4 and S5 statements are employed in connection with writing for a print out and the format of the print out of a heading.

TABLE I

```
                C*********************************************************
                C
                C  PROGRAM TO GENERATE MILLING COORDINATES FOR ELLIPTIC REFLECTOR
                C
                C*********************************************************
0001                  REAL K,H,C,S,B,D,A,R,X(10),Y(10),W,Z,Q,DEL,THAT,SY,T
0002                  IRDR=1
0003                  IPTR=3
                C
                C WRITE HEADING LINES
                C
0004                  WRITE (  IPTR,10)
0005               10 FORMAT (1H1,42HMILLING COORDINATES FOR ELLIPTIC REFLECTOR)
0006              100 READ (  IRDR,20)J,K,H,C,S,DEL
0007               20 FORMAT (I3,7X,7F10.0)
0008                  IF (J-999)110,900,900
0009              110 WRITE (  IPTR,30)K,H,C,S,DEL
0010               30 FORMAT (1H0,28HHEAD PIVOT TO CUT SURFACE = ,F7.3/27H SPOT DISTANCE
                     1 FROM LAMP = ,F8.3/22H REFLECTOR DIAMETER = ,F7.3/15H SPOT RADIUS
                     2= ,F8.3/35H SLOPE OF OUTSIDE SEGMENT CIRCLE = ,F9.5//)
0011                  ILINE=4
                C
                C  ROUTINE TO DETERMINE A AND B FROM THE DIAMETER C
                C
0012                  SI=(C/2)**2-S*C/2+H**2/4
0013                  X(7)=((S-C)*(DEL**2-1)+(SQRT((C-S)**2*(DEL**2-1)**2+8*DEL*(2*DEL*S
                     1I-(DEL**2-1)*S*H/2))))/4/DEL
0014                  ALFA=(H**2*X(7)**2-2*H*S*X(7)*C/2+H*S**2*X(7)+S**2*(C/2)**2-S**3*C
                     1/2+S**4/4)/(H**2+S**2)
0015                  GAMA=(S**2*X(7)**2+2*H*S*X(7)*C/2-H*S**2*X(7)+H**2*(C/2)**2-S*H**2
                     1*C/2+S**2*H**2/4)/(H**2+S**2)
0016                  RO=(H**2+S**2)/4-ALFA-GAMA
0017                  BPRIM2= (SQRT(RO**2+(H**2+S**2)*GAMA)-RO)/2
0018                  APRIM2=BPRIM2+(H**2+S**2)/4
0019                  EPSI=((APRIM2*BPRIM2*(H**2+S**2))/(APRIM2*H*(S*X(7)+H*C/2-S*H/2)-B
                     1PRIM2*S*(H*X(7)-S*C/2+S**2/2)))+S/2
0020                  CHI=C**2/4+C*X(7)/DEL+X(7)**2/DEL**2
0021                  CHO=2*EPSI*(C/2*DEL**2+X(7)*DEL)-H**2/4+CHI
0022                  B=SQRT((CHO-SQRT(CHO**2+4*CHI*(DEL**2+1)*(H**2/4-EPSI**2*DEL**2)))
                     1/2/(DEL**2+1))
0023                  A=SQRT(H**2/4+B**2)
0024                  D=A-H/2
0025                  THAT=ATAN(S/H)
                C
                C DO COMMON ARITHMETIC ROUTINES
                C
0026                  X(3)=0
0027                  X(4)=0
0028                  X(5)=0
0029                  Y(3)=0
0030                  Y(4)=0
0031                  Y(5)=0
0032                  WRITE (  IPTR,40)D,A,B,X(7),EPSI,ALFA,GAMA,RO,BPRIM2,APRIM2,SI,CHO
0033               40 FORMAT (21H REFLECTOR TO LAMP = ,F7.4/21H INITIAL VALUE OF X = ,F9
                     1.4,3X,4H B = ,10F9.4//)
0034                  W=X(7)
0035                  Z=C/2
0036                  I=1
0037                  GO TO 220
                C
                C RECURSIVE ROUTINE
                C
0038              200 IF (Y(1))999,999,210
```

TABLE I (cont.)

```
0039          210 W=X(1)
0040              Z=Y(1)
0041          220 IF (I-1)300,300,400
            C
            C ENDING AND PAGING
            C
0042          910 ILINE=0
0043              WRITE (IPTR,70)
0044           70 FORMAT (1H1)
0045              GO TO 210
0046          999 WRITE (IPTR,70)
0047              GO TO 100
            C
            C CALCULATE TANGENT DIAMETER ON ELLIPSE - PRINT RESULT
            C
0048          300 I=2
0049              Y(10)=SQRT(B**2*W**2-A**2*B**2+A**2*Z**2)
0050              X(10)=W**2+Z**2*A**2/B**2
0051              Y(1)=(A**2*Z-Y(10)*W)/X(10)
0052              X(1)=A*SQRT(1-Y(1)**2/B**2)
0053              T=ATAN((W-X(1))/(Y(1)-Z))
0054              TE=360*T/6.283
0055              X(2)=A-X(1)+K*(1-COS(T))
0056              X(5)=X(2)-X(4)
0057              X(3)=X(3)+X(5)
0058              X(4)=X(2)
0059              Y(2)=Y(1)+K*SIN(T)
0060              Y(5)=Y(2)-Y(4)
0061              Y(3)=Y(3)+Y(5)
0062              Y(4)=Y(2)
0063              SY=ATAN(SIN(THAT)*COTAN(T))
0064              GE=2*(Y(1)*TAN(SY)*COS(THAT)+(H/2-X(1)+Y(1)*TAN(SY)*SIN(THAT))*TAN
                 1(THAT))
0065              G=360/(AINT((6.283*Y(1)/GE)+0.5))
0066              PHY1=360*ATAN(Y(1)/(X(1)-H/2))/6.283-2*TE
0067              PHY2=360*ATAN(Z/(W-H/2))/6.283-2*TE
0068               DEG=TE
0069              DEG=AINT(TE)
0070              MINO=(TE-DEG)*60+0.5
0071              WRITE (IPTR,60)IDEG,MINO,X(3),Y(3),G,X(1),Y(1),PHY2,PHY1
0072           60 FORMAT (1H ,11HAXIS ANGLE ,I3,6H DEG. ,I3,5H MIN.,4X,3H UP,F9.4,3X
                 1,4H OUT,F9.4,7X,14H RADIAL ANGLE ,F6.2,8H DEGREES,2F9.4,2F7.2)
0073              ILINE=ILINE+1
0074              IF (ILINE-19)210,910,910
            C
            C CALCULATE END POINT OF SURFACE
            C
0075          400 I=1
0076              X(9)=(B**2*W*H+A**2*Z*S)*(A**2*Z*H-B**2*W*S)
0077              X(8)=4*A**2*(B**2+Z*S/2)
0078              X(1)=A**2*(Z*X(9)/X(8)+B**4*W+B**2*W*Z*S/2)/(A**4*Z**2+B**4*W**2)
0079              Y(1)=B**2*(1-W*X(1)/A**2)/Z
0080              PHY3=2*TE-360*ATAN(Y(1)/(X(1)-H/2))/6.283
0081              WRITE (IPTR,51)X(1),Y(1),PHY3
0082           51 FORMAT (100X,F9.4,F9.4,F8.2/)
0083              GO TO 200
0084          900 STOP
0085              END
```

In S6, specific values for the parameters, K, H, C, S, and DEL are read into memory. These values defined explicitly a particular reflector design in accordance with the present invention. The value J defines the number of times different specific values of the other parameters are to be entered and hence the number of reflectors to be processed. If one reflector is to be processed, J is set equal to 998 in the first access of S6 and 999 in the second access.

In statements S7 through S10, print out, stopping and formatting of the program are controlled in a conventional manner.

In S11, the value of the quantity ILINE is set equal to four to set up for format control.

The statements S12 through S25 are a routine for determining the parameters A and B as a function of the specific values loaded in S6. The A and B parameters in the program correspond respectively to the X and Y axis intercepts, a and b, employed in the figures and other parts of the specification. The routine from statement S12 through statement S25 corresponds to that portion of the specification previously designated as Determination of Fundamental Non-Rotated Ellipse Parameters and which is discussed in Eq. (35) through Eq. (68).

In S12, a calculation in accordance with Eq. (45) is carried out. The value SI in the program is the same as the value $\phi$ in Eq. (45). In the program, the symbol "" represents raising to a power. Accordingly, "X2" designates $X^2$. In a similar manner, the symbol "*" denotes multiplication in the usual manner.

In S13, the quantity X(7) corresponds to the quantity $X_1$ in Eq. (44). S13 performs a calculation corresponding to Eq. (44).

In S14, a calculation in accordance with Eq. (47) is carried out where ALFA corresponds to $\alpha$.

In S15, a calculation in accordance with Eq. (48) is carried out where GAMA corresponds to $\gamma$.

In S16, a calculation in accordance with Eq. (49) is carried out where RO corresponds to $\rho$.

In S17, a calculation in accordance with Eq. (52) is carried out where BPRIM2 corresponds to $b'^2$.

In S18, a calculation in accordance with Eq. (53) is carried out where APRIM2 corresponds to $a'^2$.

In S19, a calculation in accordance with Eq. (57) is carried out where EPSI corresponds to $\epsilon$.

In S20, a calculation in accordance with Eq. (67) is carried out where CHI corresponds to $\xi$.

In S21, a calculation in accordance with Eq. (66) is carried out where CHO corresponds to $\psi$.

In S22, a calculation in accordance with Eq. (65) is carried out. In S22, the value of B, corresponding to the Y axis coordinate b, is calculated.

In S23, the value of A, corresponding to the X axis coordinate a, is calculated using the results of S22 and in accordance with Eq. (68).

In S24, the results of S23 are utilized to calculate D, the distance from the focus F1 to the X axis intercept at A.

In S25, the angle THAT is calculated as the arc tangent of S/H.

In S26 through S31, parameters hereinafter employed are all set to zero.

In S32, the results of calculations performed are written in a format specified by S33.

In S34, W is set equal to X(7), which was calculated in S13, The significance of S34 is to set the end point for the X axis coordinate W equal to the value calculated in accordance with Eq. (44). That value is the extreme X axis coordinate of the reflector, point 7 in FIG. 9.

In S35, the Y axis coordinate Z, is set equal to C/2. Therefore, the end point set for the Y axis coordinate is the edge of the reflector at the extreme outer diameter, C/2, and point 7 in FIG. 9.

In S36, the program control variable I is set to equal to 1.

In S37, a branch to location 220 is taken which is S41.

In S41, the value of I−1 is examined for less than, equal to, or greater than zero values. Since I was set to 1 in S36, the evaluation of S41 is zero and hence the program branches to location 300 which is S48.

In S48, the program control variable I is set equal to 2.

In S49 through S51, calculations are performed in accordance with Eq. (6). In S49, Y(10) is formed in accordance with portions of Eq. (6) under the square root sign. In S50, X(10) is calculated as the denominator portion of Eq. (6). In S51, the results of S49 and S50 are combined to form the final calculation in accordance with Eq. (6).

In S52, the results of S51 are employed to calculate X(1) using a modified form of Eq. (1).

The Y(1) value of S51 and the X(1) value of S52 define the tangent point of 8 in FIG. 9 at which milling is to begin for the first facet of the reflector die.

In S53, the slope of the normal line to tangent line TL of the first facet is calculated in radians and is designated T.

In S54, the value of T in S53 is converted from radians to degrees and is designated TE.

In S55, the first X coordinate, X(2) for milling is calculated in terms of the change required from the initial location at A along the X axis in FIG. 9. The change in X coordinate from the A location is equal to the value of X(1) calculated in S52 plus the X axis correction factor K·(1−COS T). The correction factor accounts for the rotation by an angle of TE degrees (equal to $\omega$) for a milling machine having a deplacement K. In FIG. 9, the correction factor is shown as $q$.

In S56, X(5) is formed as the difference X(2) − X(4). For the first execution of S56, X(4) was set equal to zero in S30. Therefore, X(5) equals X(2).

In S57, X(3) is set equal to X(3)+X(5). Again, X(3) was set equal to zero in S26. S57 is an accumulator which accumulates the running value of X axis coordinate for the milling machine.

In S58, X(4) is set equal to X(2).

In S59, the Y(1) value of S51 is corrected by the Y axis correction factor K·SIN(T) which is required because of the rotation of the machining head as indicated in FIG. 9. Referring to FIG. 9, where the angle $\omega$ is equivalent to T in S59, the correction factor is shown as e.

In S60, the value of Y(5) is set equal to Y(2)−Y(4). In the first pass, Y(4) was set equal to zero in S30.

In S61, Y(4) is set equal to Y(2).

In S63, the value of $\phi$ in Eq. (89) is calculated where SY in the program is equal to $\phi$ in Eq. (89).

In S64, the results of S63 are employed to calculate the value GE in accordance with Eq. (92). The value of S64 is an exact calculation of the width of a facet as explained in connection with Eq. (93). Since the reflector, in accordance with the present invention, preferably has an integral number of equally sized facets, the exact calculation of S63 has to be modified to provide a dimension which yields an integral number of facets.

In S65, a calculation is made using the number GE from S64 to form the angle G which defines that integral number of facets having most closely the measurement GE as calculated in S64.

In S66, PHY1 is a calculation of the angle of the angle at the point Y1 and X1, that is, point 8 of FIG. 9.

In S67, the number PHY2 is a calculation of the angle of the facet at the points Z and W, that is, at point 7 in FIG. 9.

In S68, the number IDEG is set equal to the TE value calculated in S54 so that IDEG is equal to $\omega$ in FIG. 9.

In S69, the value DEG is rounded to the nearest whole number of degrees contained in the value of TE.

In S70, the fractional remainder rounded in S69 is set equal to MINO and is converted to minutes.

In S71, the results of the previous calculations are written in a format determined by S72.

In S73, ILINE is incremented by 1.

In S74, the value of ILINE is compared with 19. If less than 19, the program branches to 210 which is S39.

In S39, W is set equal to X(1) as calculated in S52.

In S40, Z is set equal to Y(1) as calculated in S51.

In S41, I−1 is evaluated and if greater than zero then the instruction branches to location 400 which is S75.

In S75, I is set equal to 1.

In S76 through S78, the value of X(1) is calculated in accordance with Eq. (31).

In S78, X(1) is equal to $x_1$ in Eq. (31).

In S77, the value of Y(1), equal to $y_1$, is calculated in accordance with Eq. (32) using the results of S78.

In S80, the angle PHY3 employs the results of S78 and S79 to form the angle of the next facet at the end point, point 9 in FIG. 9.

In S81 and S82, the results of the previous calculations are written in the format indicated.

In S83, the program goes to location 200 which is S38.

In S38, Y(1) is compared with zero. If less than or equal to zero, then the program goes to location 999 which is S46 and the program is over for a first reflector. S47 returns the program to S6 where values for a new reflector are read. If J is equal to 999, then the program in S8 goes to S84 and stops. If J is less than 999 and if Y(1) is greater than zero, then the program goes to 210 which is S39. At S39, the program sets W equal to X(1) as calculated in S78.

In S40, the program sets Z equal to Y(1) as calculated in S79.

In S41, I−1 is less than or equal to zero because of S75, and therefore, the program goes to location 300 which is S48. From this point on, the program repeats the calculations in the manner previously described.

The program will continue in this manner until Y(1) is less than or equal to zero.

A specific example of a reflector design in accordance with the FIGS. 1, 9 and 10 as determined using TABLE I is set forth in the following TABLE II. The symbols in TABLE II correspond to those in TABLE I. The labels S6, S32, S71, and S81 on the left hand margin of TABLE II identify the statements in TABLE I where the data format of the data of TABLE II is identified.

Figure 10:
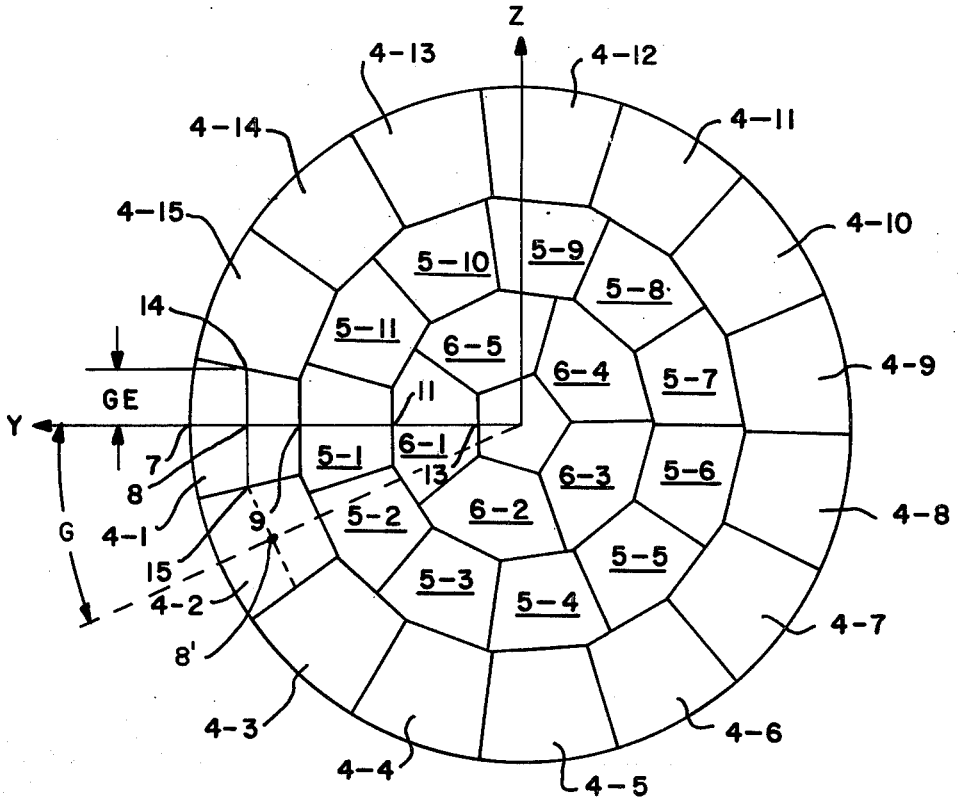
FIG. 10 depicts a top view of the structure of FIG. 9 as shown in the YZ plane.

The significance of the data of TABLE II is understood referred to FIGS. 9 and 10.

TABLE II

| S6 | J | K | H(h) | C | S(s) | DEL(tan ω) |
|---|---|---|---|---|---|---|
| | 998 | 7.000 | 3.000 | 2.000 | 0.750 | 0.57735 |

| S32 | D | A | B | X(7) | EPSI | ALFA |
|---|---|---|---|---|---|---|
| | 0.9962 | 2.4962 | 1.9952 | 2.1718 | 4.7617 | 3.8236 |
| S32 | GAMA | RC | BPRIM2 | APRIM2 | SI | CHO |
| | 1.2839 | −2.71-69 | 3.5754 | 5.9660 | 2.5000 | 35.5403 |

| S71 | IDEG | MINO | X(3) | Y(3) | G | X(1) | Y(1) | PHY2 | PHY1 |
|---|---|---|---|---|---|---|---|---|---|
| TIER1(4-) | 29° | 60′ | 1.1673 | 4.3356 | 24.00 | 2.2665 | 0.8360 | −3.89 | −12.51 |
| TIER2(5-) | 19° | 39′ | 0.5036 | 2.9019 | 32.73 | 2.4003 | 0.5477 | 0.09 | −7.99 |
| TIER3(6-) | 9° | 13′ | 0.1110 | 1.3769 | 72.00 | 2.4735 | 0.2565 | 4.60 | −3.69 |
| END | −1° | −20′ | 0.0024 | −0.0024 | 360.00 | 2.4958 | −3.03-76 | 8.98 | 0.54 |

| S81 | X(1) | Y(1) | PHY(3) |
|---|---|---|---|
| TIER1(4-) | 2.3474 | 0.6960 | 20.60 |
| TIER2(5-) | 2.4515 | 0.4043 | 16.28 |
| TIER3(6-) | 2.4992 | 0.1101 | 12.14 |
| END | 2.4992 | −0.18-78 | 8.02 |

In FIG. 9, a die 55 is shown sitting on a milling machine table 56. The die 55 is convex as a result of being machined by the milling machine 51 to have the generally convex shape indicated. The die 55 is a typical embodiment made from tool steel but can be any other suitable material for machining. The die 55 is shown after machining has been completed in accordance with the present invention.

The milling machine includes the drive member 51 which holds a cutting tool having a shaft 52 and a cutting head 53. The bottom of the cutting head 53 is the surface 54. The milling machine is translatable so that the point 57 may be moved in both the X axis and the Y axis direction. Also, the cutting head may be rotated around point 57 in the XY plane. The length from the point 57 to the cutting surface 54 is the machine constant K. In one embodiment, K is equal to 7 inches.

The indexing table 56 rotates around the X axis in the YZ plane.

In FIG. 9, the milling machine 51 is shown with the cutting head surface 54 positioned in the X axis at intercept, [+a] and positioned in the Y axis at a value of [0]. In FIG. 9, the milling machine 51 is shown as 51′ after movement in the Y axis direction to the Y(3) value calculated in S61 of TABLE I. That Y(3) value is the position of point 57″ in FIG. 9. For the example of TABLE II, Y(3) has a value in TIER 1 of 4.3356. Also, the milling machine 51′ has been rotated the angle ω, which for the example of TABLE II, TIER 1, is 59° and 59′.

In FIG. 9, the X axis position of the milling machine 51′ is shown prior to any X axis movement. When the milling machine cutting head 53′ is moved in the X axis direction, the milling machine is effective to make a cut in die 55 which results in the planar surface 7, 8, 9, that is, the formation of a facet in the outer tier. The facet shown in FIG. 9 is the facet 4-1 of FIG. 10. In the example of TABLE II, the X axis movement for the facet 4-1 is an X(3) coordinate of 1.1673.

After facet 4-1 has been machined as indicated in connection with FIG. 9, table 56 is rotated by an amount of G degrees as shown in FIG. 10. Thereafter, the facet 4-2 is machined in the same manner as was facet 4-1. In the example of TABLE II, G is equal to 24.00 degrees for TIER I. The process of machining the facets in the outer tier continues until all of the facets 4-1 through 4-15 have been completed.

Thereafter, the same steps are repeated for the facets 5-1 through 5-11 using the coordinates for TIER II from TABLE II. When the second tier of facets 5-1 through 5-11 have been completed, the steps are again repeated for the inner tier using the TIER III coordinates from TABLE II.

When the inner tier has been completed, a convex die has been formed for producing a reflector.

The die thus formed is then used to form a concave reflector of the type shown in FIG. 1. In a typical embodiment, the reflector is formed by transfer molding using a thermal setting material. The reflector of FIG. 1 is typically molded plastic having facets defined by the die 55 of FIGS. 9 and 10.

Once the reflector has been formed, the surface of each of the facets of the reflector is treated with a highly reflective surface using any conventional deposition technique, for example, metal plating. When thus prepared, the reflecting power of the surface of each of the facets in each of the tiers is substantially uniform.

Description Summary

In accordance with the present invention, the above steps produce a reflector having a plurality of facets. The reflector is formed about an imaginary spheroid surface defined by an ellipse of revolution. The fundamental ellipse defining the spheroid is discussed in connection with Eqs. (1) through (68) in the specification.

The revolution of the ellipse to form an imaginary spheroid surface results as a function of the indexing of the table 56. As indicated in FIG. 1, the ellipse has a first focus F1 and a second focus F2 along the major axis which is the X axis. In the embodiment described, the facets of the reflector of FIG. 1 are arrayed in the tiers 4-, 5-, and 6-. The tiers are located opposite the first focus F1, that is, farthest from the focus F2. The above steps result in a central point, for example, the geometric center point, of each facet having a point of tangency on the spheroid surface. Referring to FIG. 1, the central point of facet 4-1 is the geometric center point 8. The point 8 is a tangent point on the spheroid surface. Also, the facets have been constructed with outer bounds correlated to the size of the area to be illuminated. For example, in FIG. 1, the point 14 on one edge of facet 4-1 is its outer bound and that outer bound defines the outer bound 24 of the illuminated area 3. In a similar manner, the outer bounds 15, 7 and 9 of facet 4-1 result in the outer bounds 25, 17, and 19, respectively, of the illuminated area 3.

In accordance with the present invention, each of the facets of FIG. 1 is designed so that it collects substantially all of the incident light radiated from light source 16 located at focus F1 and reflects it onto the illuminated area. For this reason, the reflector is efficient in that substantially all of the incident light is reflected onto the area to be illuminated. Furthermore, the flux density on the illuminated area is substantially uniform since each facet reflects light uniformly over substantially the entire illuminated area. Because each facet reflects light over the entire illuminated area, the reflector tends to minimize the shadow effect. Specifically, an object inserted directly between facets 4-1 and area 3, but close to facet 4-1, would tend to reduce the light from facet 4-1. However, each of the other facets would illuminate the area 3 so that no shadows would be seen.

The example of TABLE II is a reflector which has three tiers of facets, 15 facets in the outer tier, 11 facets in the middle tier and 5 facets in the inner tier.

In accordance with the present invention, the following TABLE III is an example of a reflector having four tiers of facets. A number of facets, from outer tier to inner tier, for each tier is 9, 11, 8, and 4, respectively.

In a similar manner, TABLE IV is an example of a reflector having five tiers. The number of facets from outer tier to inner tier is 28, 23, 18, 13, and 7, respectively.

TABLE III (9/11/8/4)

| Tier | G | H(h) | C | S(s) | DEL (tan ω) |
|---|---|---|---|---|---|
| — | — | 120.000 | 3.500 | 36.000 | 1.73205 |
| 1 | 40.00° | | | | |
| 2 | 32.73° | | | | |
| 3 | 45.00° | | | | |
| 4 | 90.00° | | | | |

TABLE IV (28/23/18/13/7)

| Tier | G | H(h) | C | S(s) | DEL (tan ω) |
|---|---|---|---|---|---|
| — | — | 30 | 16 | 4 | 0.57735 |
| 28 | 1 | 12.86 | | | |
| 23 | 2 | 15.65 | | | |
| 18 | 3 | 20.00 | | | |
| 13 | 4 | 27.69 | | | |
| 7 | 5 | 51.43 | | | |

In FIG. 1, the illuminated area 3 (within the circle) has uniform flux distribution of the incident light. The circular area 3, in the plane of the focus 2, receives light from the areas 3 of the facet 4-1 and from similar circular areas on each of the facets of the reflector 2. The illuminated area outside the circle 3 and within the area 4-1' corresponds to the area outside the circle 3' but within the facet 4-1. The area outside the circle 3 and within the area 4-1' has a non-uniform flux gradient since each of the facets reflect somewhat differently in that area.

In the embodiment of the present invention shown in FIG. 1, the areas outside the circles such as 3' and 3'' on the facets are planar giving rise to the regions outside the circle 3. However, in accordance with another embodiment, those regions are changed from planar to parabolic or elliptical surfaces so as to cause substantially all of the illumination to be directed within the illuminated area 3.

It is apparent from the above description that through the use of planar, parabolic, elliptical or other shape facets, the size and shape of the illuminated area can be selectively determined. For example, the illuminated area can be a circle as discussed in the previous paragraph. A circular shape is only one embodiment and any desired shape can be determined by appropriate selection of the facet size and shape. The formation of a specific shape for the illuminated area is particularly useful in the illumination of displays. When utilized for displays and in other applications, the present invention minimizes shadows from objects inserted between the light source and the illuminated area. Shadows are minimized because of the mapping of light from each facet onto substantially the total illuminated area. The technique of specifying a particular shape for the illuminated area is useful particularly when the light source is located farther from the reflector than when the light source is close to the reflector. However, in any of the embodiments of the invention, the illuminated area can be shaped by appropriate selection of the location, size and shape of the facets in the reflector.

In accordance with the present invention, the reflector and the light source can be positioned such that a large protion of the output radiation from the light soucre is captured and efficiently utilized by the reflector. The illumination devices in accordance with the present invention are, therefore, efficient in their collection and reflection of radiated light.

As is apparent from the above description of preferred embodiments of the invention, many variations in the details are possible. Without specific mention of all variations, it should be noted that the relative size of the illuminated area to the reflector area is variable. For example, the illuminated area can range from larger than to smaller than the cross-sectional area of the reflector.

In accordance with other embodiments of the present invention, the facets of the reflector are not organized in tiers but alternatively are arrayed in some other order. Facets still are arrayed so that a central point such as the geometric center point of each facet is a tangent point on the spheroid surface. In one example of an embodiment which does not employ tiers, a small facet is located approximately at the major axis of the reflector of FIG. 1. Additional facets of increasing size are located following the shape of a spiral. The spiral forms a helix on the surface of the spheroid. For such an embodiment, calculations of the program of TABLE I remain the same for calculating the fundamental parameters of the ellipse. However, the program is modified for calculating the coordinates and the angle of each facet in accordance with the spiral and some predetermined size value. For example, the width of each successive facet is made a certain percentage larger than the previous facet as the facets proceed around the helix.

While tiers and helical arrays have been specifically discussed, additional types of arrays are also contemplated as being part of the present invention. Such additional arrays take the form for example, of radially extending facets radiating along lines emanating from the center of the reflector on the X axis. Another example is the use of elliptical arrays formed as elliptical elements of a spheroid of revolution. A still additional example includes facets or zones which are positioned at random, which have random sizes, or which have random shapes. Such facets or zones are selected in terms of placement, size and shape with any desired algorithm.

While the invention has been particularly shown and described with reference to a preferred embodiment thereof it will be understood by those skilled in the art that the foregoing and other changes in form and details may be made therein without departing from the spirit and scope of the invention.

What is claimed is:

1. A light assembly comprising, a reflector formed by a plurality of facets, said reflector formed about an imaginary spheroid surface defined by an ellipse of revolution having a first focus and a second focus along a major axis, said facets arrayed opposite said first focus so that a central point of each facet is substantially a tangent point on said spheroid surface, said facets constructed with outer bounds correlated to the size of an illuminated area, a light source located at said first focus for radiating light to said reflector to form said illuminated area in a plane normal to said major axis at said second focus whereby the light reflected from the outer bounds of each of said facets forms the outer bounds of the illuminated area.

2. The light assembly of claim 1 wherein said facets are arrayed in tiers concentric to said major axis.

3. The light assembly of claim 2 wherein each of the facets in the same tier is substantially the same area.

4. The light assembly of claim 3 wherein the reflecting power of the surface of the facets in each of said tiers is substantially uniform.

5. The light assembly of claim 3 wherein said tiers are arrayed from an inner tier closest to said major axis to an outer tier farthest from said major axis and wherein the area of each of the facets in each tier increases from said inner tier to said outer tier.

6. The light assembly of claim 1 wherein each of said facets are planar.

7. The light assembly of claim 1 wherein said facets are arrayed in tiers concentric to said major axis and said light assembly is uniquely defined by the parameters: "h," equal to the distance between foci; "C," equal to the maximum diameter of said reflector; "s," equal to the diameter of said area to be illuminated; and "ω," equal to the angle that a line, normal to a facet in a tier farthest from said major axis, makes with said major axis.

8. The light assembly of claim 1 wherein the reflecting power of the surface of each of said facets is substantially uniform.

9. The light assembly of claim 1 wherein each of said facets reflect light into said illuminated area to form said illuminated area with a predetermined shape.

10. A light assembly comprising, a reflector formed by a plurality of facets, said reflector formed about an imaginary surface generated substantially by a revolution of a conic section having a focus along a major axis, said facets arrayed opposite said first focus so that a central point of each facet is substantially a tangent point on said surface, said facets constructed with outer bounds correlated to the size of an illuminated area, a light source located substantially at said first focus for radiating light to said reflector to form said illuminated area in a plane normal to said major axis at substantially said second focus whereby the light reflected from the outer bound of each of said facets forms the outer bounds of the illuminated area.

11. A light assembly comprising, a reflector formed by a plurality of planar facets, said reflector formed about an imaginary spheroid surface defined by an ellipse of revolution having a first focus and a second focus along a major axis, said facets arrayed opposite said first focus so that a central point of each facet is substantially a tangent point on said spheroid surface, said facets arrayed in tiers concentric to and enclosing said major axis, said facets constructed with outer bounds correlated to the size of an illuminated area, a light source located at said first focus for radiating light to said reflector to form said illuminated area in a plane normal to said major axis at said second focus whereby the light reflected from the outer bounds of each of said facets forms the outer bounds of the illuminated area.

12. The light assembly of claim 11 wherein said light assembly is uniquely defined by the parameters: "h," equal to the distance between foci; "C," equal to the maximum diameter of said reflector; "s," equal to the diameter of said area to be illuminated; and "ω," equal to the angle that a line, normal to a facet in a tier farthest from said major axis, makes with said major axis.

* * * * *